US005082510A

United States Patent [19]

Nishimoto et al.

[11] Patent Number: 5,082,510

[45] Date of Patent: Jan. 21, 1992

[54] METHOD FOR PRODUCING NON-ORIENTED STEEL SHEETS

[75] Inventors: Akihiko Nishimoto; Yoshihiro Hosoya; Toskhiaki Urabe, all of Tokyo, Japan

[73] Assignee: Nippon Kokan Kabushiki Kaisha, Tokyo, Japan

[21] Appl. No.: 329,417

[22] Filed: Mar. 27, 1989

Related U.S. Application Data

[62] Division of Ser. No. 101,721, Sep. 28, 1987, abandoned.

[30] Foreign Application Priority Data

Sep. 29, 1986 [JP] Japan ..... 61-228114

[51] Int. Cl.[5] ..... H01F 1/04

[52] U.S. Cl. ..... 148/111; 148/112; 148/120; 148/121

[58] Field of Search ..... 148/111, 113, 112, 120, 148/121

[56] References Cited

U.S. PATENT DOCUMENTS 4,046,602 9/1977 Stanley ..... 148/111

FOREIGN PATENT DOCUMENTS 156651 9/1982 Fed. Rep. of Germany .

54-116321 9/1979 Japan ..... 148/111

61-119652 6/1982 Japan .

*Primary Examiner*—John P. Sheehan

*Attorney, Agent, or Firm*—Frishauf, Holtz, Goodman & Woodward

[57] ABSTRACT

A method for producing non-oriented electrical steel sheets comprising the steps of:

making steel ingots comprising contents of:

0.01 wt % and less C, 0.003 wt % and less N, 0.1 to 1.0 wt % Mn and 1.7 wt % and less Si;

Si and Al satisfying the formulas of:

$(Al\ \%) \leqq 0.69\ (Si\ \%)^2 - 2.29\ (Si\ \%) + 1.90$; and $(Al\ \%) \geqq 0.10\ (Si\ \%)^2 - 0.35\ (Si\ \%) + 0.3$, providing that (Si %) represents wt % Si content, and that (Al %) represents wt % Al content;

other contents being Fe and impurities inevitable;

hot-rolling slabs of the steel ingots at finishing temperature of 700° to 900° C. into hot-rolled steel strips to coil the hot-rolled steel strips; and cold-rolling the hot-rolled steel strips into cold-rolled steel strips, followed by annealing the cold-rolled strip sheets.

9 Claims, 5 Drawing Sheets

FIG.2
FIG. 2 (a)
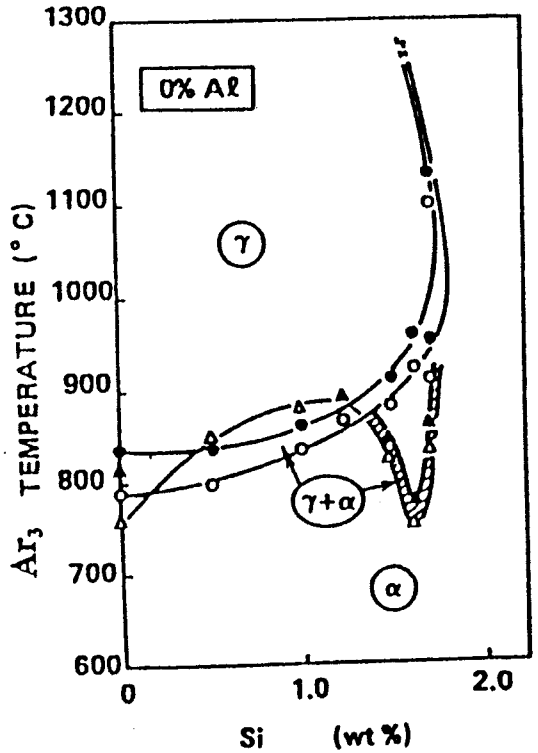
FIG. 2 (b)
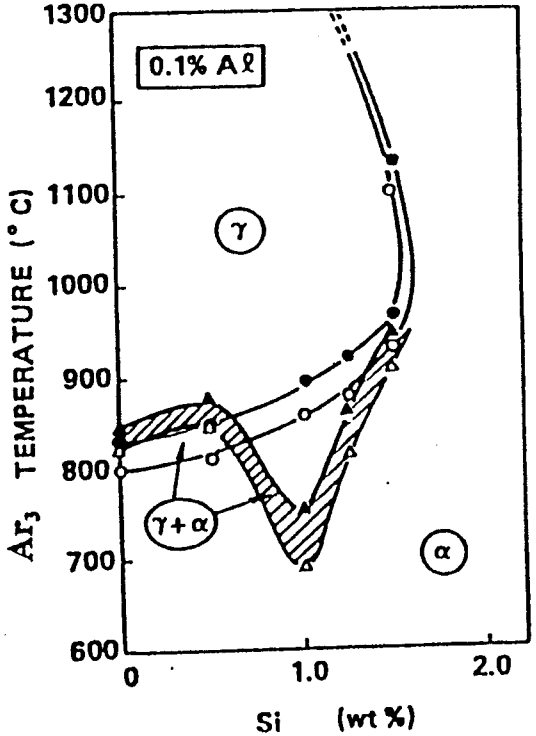
FIG. 2 (c)
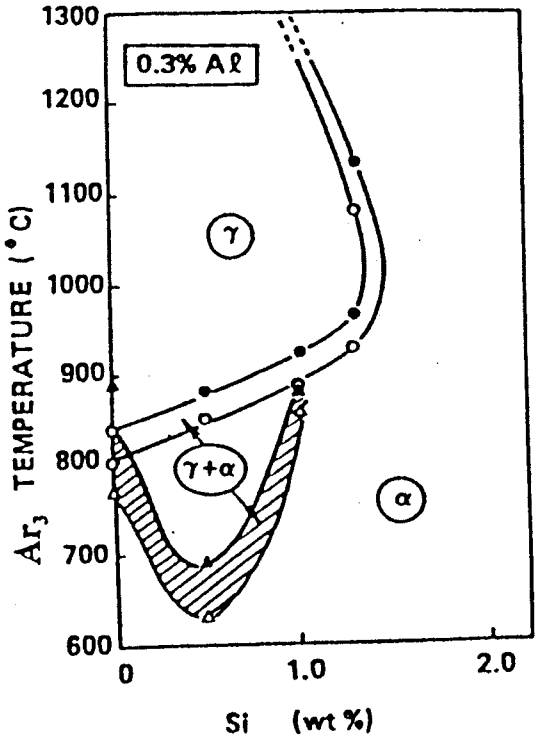

METHOD FOR PRODUCING NON-ORIENTED STEEL SHEETS

This is a division of application Ser. No. 07/101,721 filed Sept. 28, 1987 now abandoned.

BACKGROUND OF THE INVENTION

1. Field of the Invention

The present invention relates to non-oriented electrical steel sheets and a method for producing non-oriented steel sheets, and more particularly to compositions of the non-oriented electrical steel sheets and the terms of hot-rolling thereof.

2. Description of the Prior Arts

Non-oriented electrical steel sheets are widely used for core materials of electrical apparatus for example, a rotating machine. Recently, for increasing efficiency of, lightening and compacting these electrical apparatuses, materials having low core loss and high magnetic flux density have been in demand.

Steel sheets to which silicon is added, so-called silicon steel sheets have been customarily used as non-oriented electrical steel sheets. The addition of Si to steel increases specific resistance and reduces core loss value. However, because Si is an element having characteristic of allowing $\alpha$-phase to be stabilized as shown in FIG. 1, $Ar_3$ transformation point temperature of silicon steel is raised in compliance with addition of Si, and $\gamma$-phase of the silicon steel closes its loop when the addition of Si reaches a certain amount. The $\gamma$-phase of extra low carbon steel which contains no Al closes its loop at approximately 1.7 wt % Si while the critical Si-amount is decreased when Al is added to the extra-low carbon steel. Changes of $Ar_3$ transformation point temperatures of such range of 800° to 1,000° meet finishing temperatures at hot rolling. Therefore, hot rolling in the whole length at the $Ar_3$ transformation temperature becomes more difficult as Si addition amount is increased. That is to say, in the case of a steel containing 1.7 wt % Si as shown in FIG. 1, $Ar_3$ transformation point temperature reaches 900° C. and more. For this reason, conventional, methods do not permit finishing hot rolling temperatures above their $Ar_3$ transformation points.

To overcome the difficulty the art has been forced to adopt high temperature heating. However, the means for heating Si contained steel sheets at high temperature of 1,200 ° C. and more has a disadvantage in that surface smoothness property of the Si contained steel sheets is deteriorated. This is because, when the silicon contained steel sheets are heated at high temperature of 1,200 ° C. and more, slab surface scales are melted, exfoliative features of the slab surface scales before hot rolling are lowered, and scales are rolled in during the process of hot rolling.

Moreover, even if the finishing temperature is maintained at $Ar_3$ transformation point or more, by lower temperature heating, the means still has a drawback that magnetic property of the final products deteriorates, because, in this case, owing to edge portions of steel slabs being hot-rolled in the state of having ferrite and austenite dual phases, thickness and structure of the edge portions of hot-rolled steel sheets become nonuniform, due to difference of deformation resistance of the two phases.

SUMMARY OF THE INVENTION

An object of the present invention is to provide non-oriented electrical steel sheets having sharply precise thickness and highly homogeneous magnetic property and a method for producing such non-oriented electrical steel sheets.

In accordance with the present invention, non-oriented electrical steel sheets are provided, comprising the contents of:

0.01 wt % and less C, 0.003 wt % and less N and 0.1 to 1.0 wt % less Mn;

Si and Al satisfying, in wt %, the formulas of:

$(Al\%) \leqq 0.69\ (Si\%)^2 - 2.29\ (Si\%) + 1.90$ $(Al\%) \geqq 0.10\ (Si\%)^2 - 0.35\ (Si\%) + 0.3$ $(Si\%) \leqq 1.7$ wt %; and the balance being Fe and inevilable impurities Furthermore, a method is provided for producing non-oriented electrical steel sheets comprising the steps of:

making steel ingots comprising the contents of:

0.01 wt % and less C, 0.003% and less N, 0.1 to 1.0 wt % Mn, and 1.7 wt % and less Si; Si and Al satisfying, in wt %, the formulas of:

$(Al\%) \leqq 0.69\ (Si\%)^2 - 2.29\ (Si\%) + 1.90$ $(Al\%) \geqq 0.10\ (Si\%)^2 - 0.35\ (Si\%) + 0.3$; and the rest being Fe and impurities inevitable;

hot-rolling steel slabs produced through slabbing the steel ingots, at finishing temperature of 700° to 900° C., into hot-rolled steel strips, to coil the hot-rolled steel strips;

cold-rolling the hot-rolled steel strips into cold-rolled steel strips, followed by annealing the cold-rolled steel strips.

Other objects and advantages of the present invention will become apparent from the detailed description to follow taken in conjunction with the appended drawings.

BRIEF DESCRIPTION OF THE DRAWINGS

FIG. 2 is a representation of comparison of $Ar_3$ transformation point of steel sheets of the present invention which have been worked with that of the steel sheets which have not.

DESCRIPTION OF THE PREFERRED EMBODIMENT

It is preferable that non-oriented electrical steel sheets are produced at final annealing so as to have good magnetic property and still to be homogeneous. Magnetic property of steel sheets is greatly affected by their texture formed after annealing. Since this texture formed by annealing reflects a texture formed by hot rolling, the texture formed by hot rolling is a key point for improving magnetic property. Consequently, finish hot rolling is required to be completed in the state that steel is allowed to be in the area of a single phase of austenite and to be of an homogeneous structure of ferrite.

Figure 3:
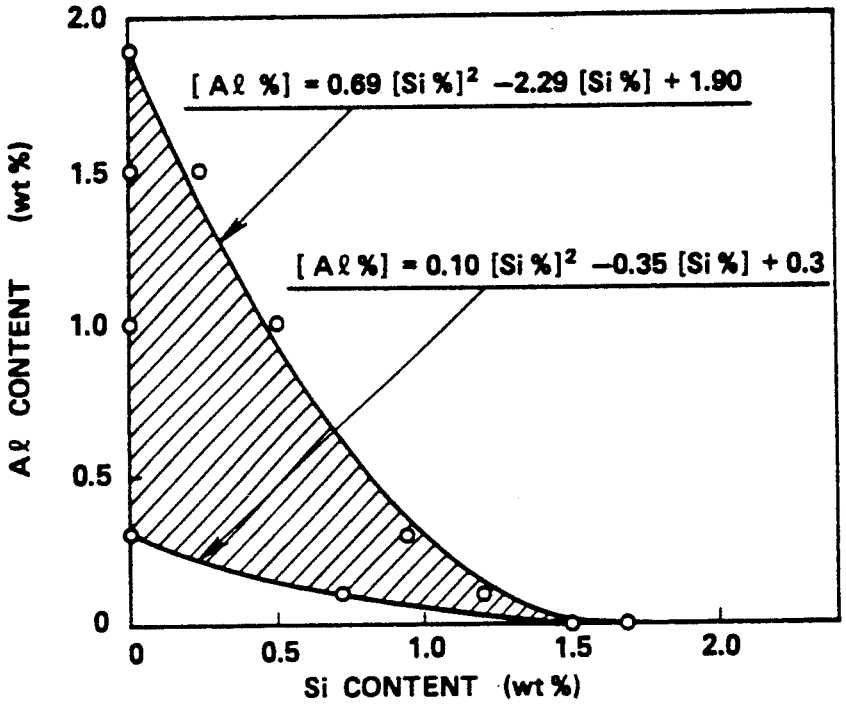
FIG. 3 is a graphic representation showing Si-Al composition area where austenite structure exists stably at 860° C.

In this connection, behavior of non-equilibrium transformation of Fe-Si-Al alloy have been pursued in detail with the results as shown in FIG. 2. FIG. 2 graphically shows comparison of $Ar_3$ transformation point of steel sheets of the present invention which have been worked with that of the steel sheets which have not. In FIG. 2, (a) shows 0% Al content, (b) 0.1% Al content and (c) 0.3% Al content Symbol character ● represents a start point of transformation, and symbol character ○ a finish point of transformation respectively in the case of the steel sheets which not been worked. Symbol character ▲ represents a start point of transformation, and symbol character Δ a finish point of transformation, respectively in the case of the steel sheets which have been worked. A steel sheet of a certain composition which been worked marks 100 ° C. decrease of $Ar_3$ transformation point in comparison with $Ar_3$ transformation point in equilibrium. FIG. 3 graphically shows Si and Al composition area of the present invention where austenite exists stably even at 860 ° C. in non-equilibrium diagram as shown in FIG. 2. Namely, in the area marked with slanted line, Si-and-A1 composition is enough to form an homogeneous ferrite structure even if hot rolling is completed at finishing temperature of 900 ° C. and less. Resultantly, if the finishing temperature can be ensured to be approximately 860 ° C., slab heating temperature is allowed to range 1,000° to 1,150 ° C., thereby remelting of AlN precipitated at solidification the steel is minimized and, still, amount of solute N is reduced. In addition, improvement in growth of grains contributes to increasing not only in magnetic permeability but also in soft magnetism such as reduction of coercive force. Furthermore, remelting of slab surface scales is reduced, and, at the same time, accuracy of thickness of steel sheets is greatly improved owing to the steel sheets being wholly of an homogeneous ferrite structure.

Secondly, the reasons for limiting specifically chemical composition of electrical steel sheets will be now described.

In the case that C is contained more than 0.01 wt % in steel, magnetic property of steel sheets is worsened, due to occurence of magnetic aging when the steel sheets are used as products. For this reason, C content of 0.01 wt % and less is preferable.

When N is contained more than 0.0030 wt % in steel, magnetic property is worsened as well. Accordingly, N content of 0.0030 wt % and less is preferable.

Si is an important element increasing specific resistance and reducing core loss. In the range of more than 1.7 wt % Si content, however, stable hot-rolling in the austenite phase cannot be performed. Thus, Si content is to be 1.7 wt % and less.

In the present invention, beside those specific arrangements of chemical composition, another control of chemical composition is carried out. A1 is an effective element of improving magnetic property as well as Si works, and , furthermore, in A1-Si contained steel, relationship between A1 and Si is controlled to satisfy formula (1) below, where (A1%) and (Si%), each represents wt % Al content and wt % Si content and hold same throughout the description herein contained. Namely, Al and Si contents are controlled so as to be within the area slanted in FIG. 3. A remarkable phenomenon that Ar3 transformation point temperature is lowered appears. If formulas (1) are satisfied austenite phase exists stably even at 860° C.

$$\left.\begin{aligned}(\text{Al }\%) &\leqq 0.69\,(\text{Si }\%)^2 - 2.29\,(\text{Si }\%) + 1.90\\ (\text{Al }\%) &\geqq 0.10\,(\text{Si }\%)^2 - 0.35\,(\text{Si }\%) + 0.3\end{aligned}\right\} \quad (1)$$

Moreover, if formulas (2) below are satisfied austenite phase exits stably even at 800 ° C.

$$\left.\begin{aligned}(\text{Al }\%) &\leqq 0.82\,(\text{Si }\%)^2 - 2.39\,(\text{Si }\%) + 1.76\\ (\text{Al }\%) &\geqq 0.15\,(\text{Si }\%)^2 - 0.46\,(\text{Si }\%) + 0.36\end{aligned}\right\} \quad (2)$$

If formulas (3) and (4), each, are satisfied, austenite phase exists stably, respectively, at 750° C. and 700° C.

$$\left.\begin{aligned}(\text{Al }\%) &\leqq 0.80\,(\text{Si }\%)^2 - 2.28\,(\text{Si }\%) + 1.60\\ (\text{Al }\%) &\geqq 0.18\,(\text{Si }\%)^2 - 0.46\,(\text{Si }\%) + 0.38\end{aligned}\right\} \quad (3)$$

$$\left.\begin{aligned}(\text{Al }\%) &\leqq 0.92\,(\text{Si }\%)^2 - 2.14\,(\text{Si }\%) + 1.25\\ (\text{Al }\%) &\geqq 0.10\,(\text{Si }\%)^2 - 0.40\,(\text{Si }\%) + 0.43\end{aligned}\right\} \quad (4)$$

Consequently, in compliance with formulas (1) to (4), if austenite phase is allowed to exist stably at lower temperature, hot-rolling can be at such lower temperature.

Figure 4:
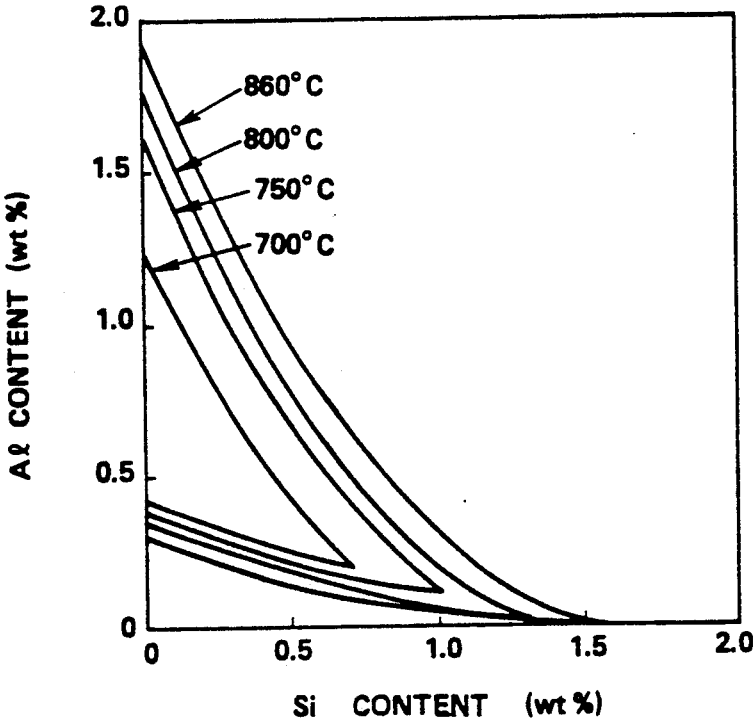
FIG. 4 is a graphic representation showing Si-Al composition area of the present invention where austenite structure exists stably at 860°, 800°, 750° and 700° C.

Furthermore, in accordance with the method of the present invention, steel ingots containing the aforementioned compositions are slabbed, thereafter rolled hot rolled at finishing temperature of 700° to 900° C. into hot rolled steel strips to coil the hot-rolled steel strips at temperature of 650° C. and more, and then the hot-rolled steel strips are cold-rolled into cold-rolled steel strips, and followed by annealing the cold-rolled steel strips. In order to reduce disadvantage of grain coarsening in the process to follow due to A1N being melted at a slab reheating process and being precipitated again after hot coiling, the coiling is completed at 650° C. and more to coarsen A1N grain size. Moreover, the lower limit of temperature is set to the lowest temperature where an austenite phase is stable in response to each of Al-Si compositions as shown in FIG. 4 because the stable area of austenite phase is changeable, as shown in FIG. 4, depending on Al-Si compositions in amount during hot working.

EXAMPLE

Figure 5:
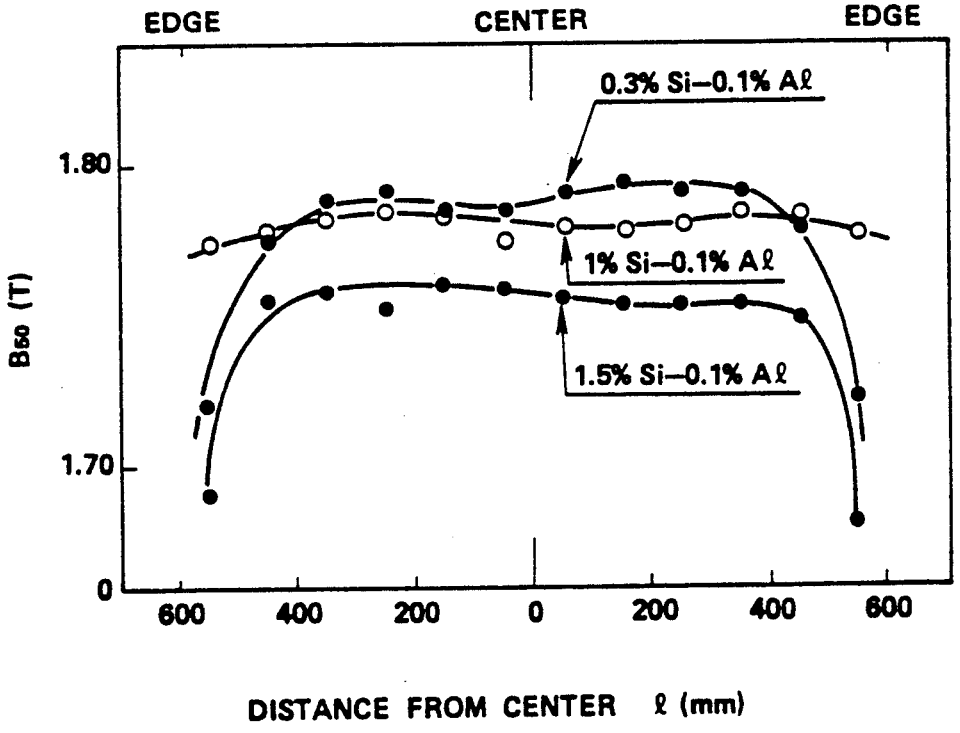
FIG. 5 is a graphic representation showing distribution of $B_{50}$ in breadth direction of test pieces taken from an example of the present invention.

Steel slabs having chemical composition as shown in Table 1 were heated in a heating furnace, and, thereafter, hot-rolled into 2.0 mm hot-rolled steel strips in thickness to coil hot-rolled steel strips. After acid pickling, the hot-rolled steel strips were reduced through cold rolling to 0.5 mm cold-rolled steel strips in thickness. The cold-rolled strips were continuously annealed at 850° C. for 2 minutes. $B_{50}$ and $W_{15/50}$ of these annealed cold-rolled steel strips are shown in table 2. Distribution of $B_{50}$ is shown in FIG. 5. $W_{15/50}$ shows core loss at frequency of 50 c/sec. and at the maximum magnetic flux density of 1.5 T. $B_{50}$ shows magnetic flux density (T) at magnetizing force of 5000 A/m. Symbol mark ● in FIG. 5 shows controllers of 0.3 wt % Si-0.1 wt % Al and 1.5 wt % Si-0.1 wt % Al, and symbol mark ○ shows an example of 1 wt % Si-0.1 wt % Al according to the present invention. On these terms, controllers showed remarkable dropping of $B_{50}$ at edge portions of the cold-rolled steel strips. This is because magnetic property of the edge portions were deteriorated owing to the edge portions having been hot-rolled in the state of being of ferrite-austenite dual phase. On the contrary, due to $Ar_3$ transformation temperatures dropping, the example of the present invention allowed hot rolling of the steel slabs of a single austenite phase on the whole breadth, and showed uniformity of $B_{50}$.

Figure 6:
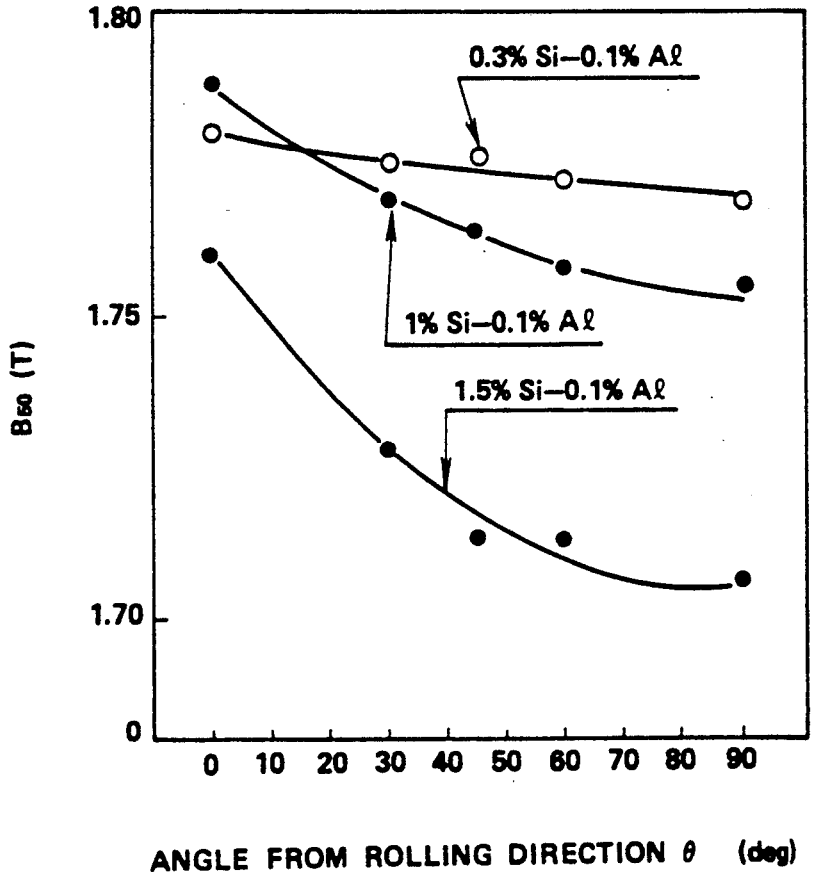
FIG. 6 is a graphic representation showing influence of plane anisotropy of test pieces taken from an example of the present invention on $B_{50}$.

FIG. 6 shows influence of plane anisotropy on $B_{50}$. Symbol mark ● in FIG. 5 shows controllers of 0.3 wt % Si-0.1 wt % Al and 1.5 wt % Si-0.1.wt % Al, and symbol mark ○ shows an example of 1 wt % Si-0.1 wt % Al according to the present invention. Any of the controllers increase reduction of $B_{50}$ as the angle formed in relation to the rolling direction is increased. The examples of the present invention shows reduction of the vicinity of 0.01T, the plane anisotropy being very small.

The magnetic property of examples No. 4 of the present invention having composition as shown in Table 1 is shown in Table 3, in the case that example No.4 was hot-rolled at finishing temperature of 870° C. and 950° C., respectively. Magnetic property even in the case of finishing temperature of 870° C. which is within the scope of the present invention and finishing temperature of 950° C. which is conventionally practised have almost no difference. In addition, core loss $W_{15/50}$ of the present invention is improved in comparison with that of a conventional method. This is because ferrite grain size became fine and uniform after hot rolling, due to low temperature rolling.

TABLE 1

| No. | C | Si | Mn | P | D | (wt %) Sol. Al | N |
|---|---|---|---|---|---|---|---|
| Examples | | | | | | | |
| 1 | 0.0021 | 0.31 | 0.18 | 0.002 | 0.005 | 0.412 | 0.0020 |
| 2 | 0.0024 | 0.29 | 0.18 | 0.002 | 0.006 | 0.867 | 0.0024 |
| 3 | 0.0024 | 0.72 | 0.17 | 0.003 | 0.005 | 0.420 | 0.0023 |
| 4 | 0.0021 | 1.01 | 0.18 | 0.002 | 0.005 | 0.102 | 0.0029 |
| Controllers | | | | | | | |
| 5 | 0.0021 | 0.32 | 0.18 | 0.003 | 0.005 | 0.110 | 0.0021 |
| 6 | 0.0022 | 0.71 | 0.18 | 0.002 | 0.006 | 1.203 | 0.0025 |
| 7 | 0.0023 | 1.42 | 0.18 | 0.002 | 0.006 | 0.431 | 0.0022 |
| 8 | 0.0023 | 1.53 | 0.17 | 0.002 | 0.005 | 0.112 | 0.0024 |

TABLE 2

| No. | $B_{50}$ (T) | $W_{15/20}$ (W/kg) |
|---|---|---|
| Examples | | |
| 1 | 1.78 | 4.73 |
| 2 | 1.77 | 4.62 |
| 3 | 1.78 | 4.71 |
| 4 | 1.78 | 4.87 |
| Controllers | | |
| 5 | 1.78 | 5.92 |
| 6 | 1.75 | 5.58 |
| 7 | 1.75 | 5.49 |
| 8 | 1.76 | 5.53 |

TABLE 3

| | Example | Controller |
|---|---|---|
| Finishing temperature | 870° C. | 950 ° C. |

TABLE 3-continued

| | Example | Controller |
|---|---|---|
| $B_{50}$ (T) | 1.78 | 1.79 |
| $W_{25/50}$ (W/kg) | 4.87 | 5.35 |

What is claimed is:

1. A method for producing a non-oriented electrical steel with precise thickness and homogeneous magnetic property comprising the steps of:

providing a steel slab, which comprises:

0.01 wt. % or less C, 0.003 wt. % or less N, 0.01 to 0.1 wt. % Mn, 1.9 wt. % or less Al, 1.7 wt. % or less Si, and the balance being Fe and inevitable impurities;

hot-rolling the steel slab in the austenite phase at a finishing temperature between a first $Ar_3$ transformation point and a second $Ar_3$ transformation point into a hot-rolled steel strip to coil the hot-rolled steel strip, said first $Ar_3$ transformation point being determined when the steel slab is being worked, and said second $Ar_3$ transformation point being determined when the steel slab is not being worked, said second $Ar_3$ transformation point being higher than said first $Ar_3$ transformation point; and cold-rolling the hot-rolled steel strip into a cold-rolled steel strip, followed by annealing the cold-rolled strip.

2. The method of claim 1, wherein the steel slab has the following composition:

0.0021 wt. % C, 0.31 wt. % Si, 0.18 wt. % Mn, 0.412 wt. % Al, the balance being Fe and inevitable impurities.

3. The method of claim 1, wherein the steel slab has the following composition;

0.0024 wt. % C, 0.29 wt. % Si, 0.18 wt. % Mn, 0.867 wt. % Al, the balance being Fe and inevitable impurities.

4. The method of claim 1, wherein the steel slab has the following composition:

0.0024 wt. % C, 0.72 wt. % Si, 0.17 wt. % Mn, 0.42 wt. % Al, the balance being Fe and inevitable impurities.

5. The method of claim 1, wherein the steel slab has the following composition:

0.0021 wt. % C, 1.01 wt. % Si, 0.18 wt. % Mn, 0.102 wt. % Al, the balance being Fe and inevitable impurities.

6. The method of claim 1, wherein the annealing is conducted at a temperature of 850° C. for 2 minutes.

7. The method of claim 1, wherein the finishing temperature is 870° C.

8. The method of claim 6, wherein the finishing temperature is 870° C.

Figure 1:
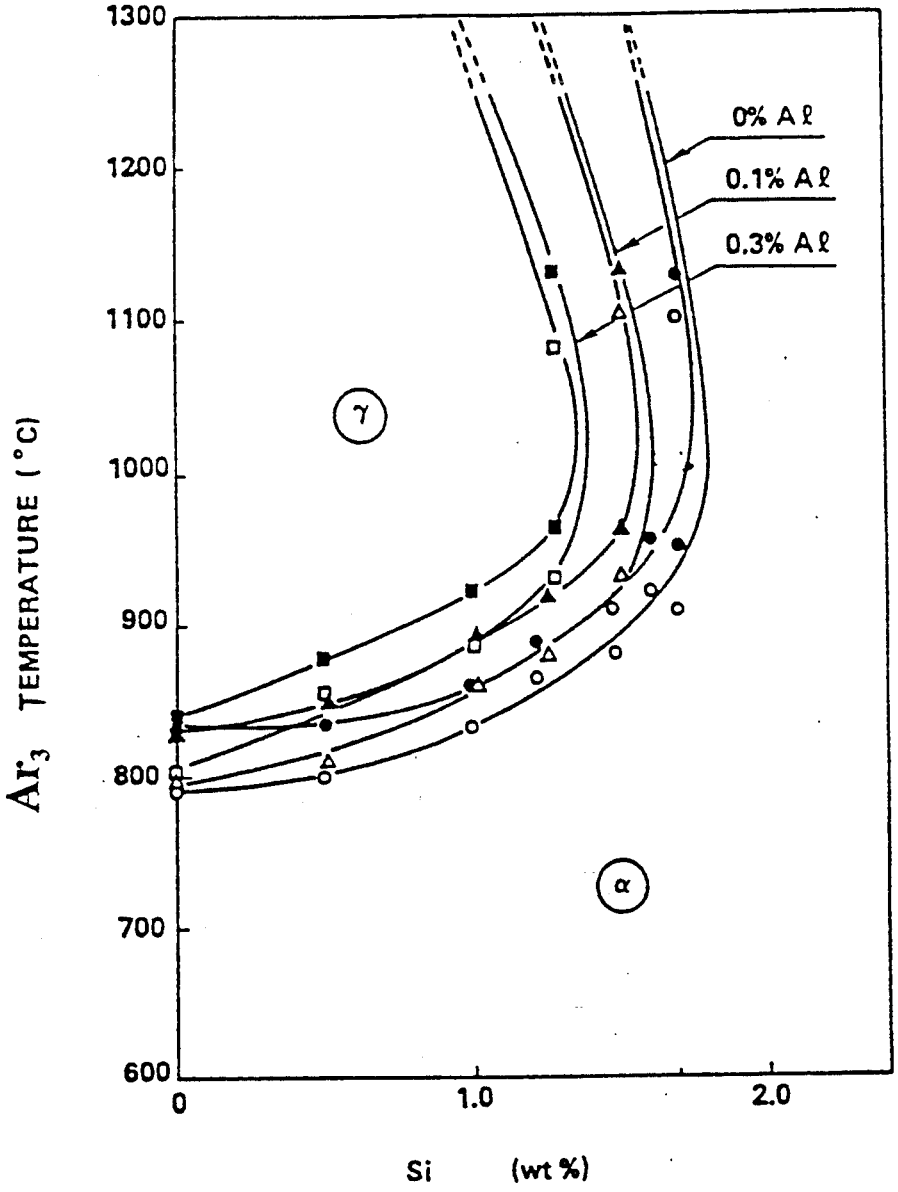
FIG. 1 PRIOR ART
FIG. 1 is a phase diagram of Fe-Si steel of a prior art.

9. The method of claim 1, wherein said second $Ar_3$ transformation point is determined from the amounts of Si and Al and the $Ar_3$ temperature relationship depicted in FIG. 1.

* * * * *

UNITED STATES PATENT AND TRADEMARK OFFICE

CERTIFICATE OF CORRECTION

PATENT NO. : 5,082,510

DATED : January 21, 1992

INVENTOR(S) : NISHIMOTO et al

It is certified that error appears in the above-identified patent and that said Letters Patent is hereby corrected as shown below:

Column 3, line 6, change "FIG.2 graphically" into a new paragraph.

Column 3, line 21, change "FIG.3 graphically" into a new paragraph.

Column 4, line 66, before "frequency", insert --a--.

Column 6, line 22 (claim 1), after "being", insert --the $Ar_3$ transformation point".

Column 6, line 23 (claim 1), delete "determined".

Column 6, line 23 (claim 1), replace "is being" with --has been--.

Column 6, line 24 (claim 1), after "being", insert --the $Ar_3$ transformation point".

Column 6, line 25 (claim 1), delete "determined".

Column 6, line 25 (claim 1), replace "is not being" with --has not been--.

UNITED STATES PATENT AND TRADEMARK OFFICE

CERTIFICATE OF CORRECTION

PATENT NO. : 5,082,510

DATED : January 21, 1992

INVENTOR(S) : NISHIMOTO et al

It is certified that error appears in the above-identified patent and that said Letters Patent is hereby corrected as shown below:

Column 6, line 28 (claim 1), after "point", insert the the following:

--, the transformation point, the contents of Al and Si being such as to provide that the finishing temperature of hot rolling is while the steel is in the austenite phase and to satisfy the following formulas in the range of the following indicated temperatures:

<u>at 860°C:</u>

$$(Al\%) \leq 0.69\ (Si\%)^2 - 2.29\ (Si\%) + 1.90$$

$$(Al\%) \geq 0.10\ (Si\%)^2 - 0.35\ (Si\%) + 0.3$$

<u>at 800°C:</u>

$$(Al\%) \leq 0.82\ (Si\%)^2 - 2.39\ (Si\%) + 1.76$$

$$(Al\%) \geq 0.15\ (Si\%)^2 - 0.46\ (Si\%) + 0.36$$

<u>at 750°C:</u>

$$(Al\%) \leq 0.80\ (Si\%)^2 - 2.28\ (Si\%) + 1.60$$

$$(Al\%) \geq 0.18\ (Si\%)^2 - 0.46\ (Si\%) + 0.38$$

UNITED STATES PATENT AND TRADEMARK OFFICE

CERTIFICATE OF CORRECTION

PATENT NO. : 5,082,510

DATED : January 21, 1992

INVENTOR(S) : NISHIMOTO et al

It is certified that error appears in the above-identified patent and that said Letters Patent is hereby corrected as shown below:

at 700°C:

$$(Al\%) \leq 0.92\ (Si\%)^2 - 2.14\ (Si\%) + 1.25$$

$$(Al\%) \geq 0.10\ (Si\%)^2 - 0.40\ (Si\%) + 0.43$$ --.

Signed and Sealed this

Twenty-fifth Day of January, 1994

*Attest:*

*Attesting Officer*

Bruce Lehman

BRUCE LEHMAN

*Commissioner of Patents and Trademarks*